US011078637B2

(12) United States Patent
Tiang

(10) Patent No.: US 11,078,637 B2
(45) Date of Patent: Aug. 3, 2021

(54) SUPPORT

(71) Applicant: Industrial Galvanizers Corporation Pty Ltd, Macquarie Park (AU)

(72) Inventor: Oliver Tiang, Acacia Ridge (AU)

(73) Assignee: Industrial Galvanizers Corporation Pty Ltd

( * ) Notice: Subject to any disclaimer, the term of this patent is extended or adjusted under 35 U.S.C. 154(b) by 0 days.

(21) Appl. No.: 15/780,069

(22) PCT Filed: Dec. 18, 2015

(86) PCT No.: PCT/AU2015/050812
§ 371 (c)(1),
(2) Date: May 30, 2018

(87) PCT Pub. No.: WO2017/100815
PCT Pub. Date: Jun. 22, 2017

(65) Prior Publication Data

US 2018/0355565 A1 Dec. 13, 2018

(51) Int. Cl.
*E04G 25/00* (2006.01)
*E01F 9/631* (2016.01)
*E04H 12/08* (2006.01)

(52) U.S. Cl.
CPC ..... *E01F 9/631* (2016.02); *E04H 12/08* (2013.01)

(58) Field of Classification Search
None
See application file for complete search history.

(56) References Cited

U.S. PATENT DOCUMENTS 126,841 A * 5/1872 Smith ..... E04H 12/08 52/651.07
1,605,639 A * 11/1926 Barrick ..... E04H 12/08 52/298
2,023,476 A * 12/1935 Hutchinson ..... E04H 12/08 174/43
3,263,302 A * 8/1966 Handley ..... E04H 12/08 29/416
4,813,199 A * 3/1989 Lewis, Jr. ..... E01F 9/635 403/2
6,685,154 B1 * 2/2004 Blyth ..... E01F 9/696 248/219.1
6,820,389 B1 * 11/2004 Macchietto ..... E04C 3/32 248/156
7,523,912 B1 * 4/2009 Woods ..... E01F 9/696 116/63 R
8,468,775 B2 * 6/2013 Vaughn ..... E02D 27/34 403/200
8,549,812 B1 * 10/2013 Peng ..... E04B 1/34305 212/348
2001/0054269 A1 * 12/2001 Miller, Jr. ..... E04B 1/0046 52/632
2007/0240377 A1 * 10/2007 Geer ..... E04H 12/185 52/632

(Continued)

*Primary Examiner* — Basil S Katcheves
(74) *Attorney, Agent, or Firm* — Dureska & Moore, LLC; David P. Dureska; David J. Danko

(57) ABSTRACT

A support for a roadside object, the support including: a hollow elongate body comprising: a first section having a plurality of first apertures separated by a first distance; and a second section having a plurality of second apertures separated by a second distance, wherein the first distance is different to the second distance.

16 Claims, 3 Drawing Sheets

(56) References Cited

U.S. PATENT DOCUMENTS

| | | | | |
|---|---|---|---|---|
| 2011/0067323 | A1* | 3/2011 | Mercier | E01F 9/635 52/98 |
| 2014/0311057 | A1* | 10/2014 | Puetz | E04H 12/182 52/121 |

* cited by examiner

SUPPORT

CROSS-REFERENCE TO RELATED APPLICATION

This application claims the benefit of PCT Application Serial No. PCT/AU2015/050812 filed Dec. 18, 2015.

FIELD OF THE INVENTION

The invention relates to a support. In particular, the invention relates, but is not limited, to a support in the form of a roadside pole.

BACKGROUND TO THE INVENTION

Reference to background art herein is not to be construed as an admission that such art constitutes common general knowledge in Australia or elsewhere.

As motorists are aware, roadside poles assist in holding up signs, lights and alike along a road. These roadside poles may be formed from a number of materials including wood, steel or concrete.

Roadside poles may present a danger to motorists in the event of an accident. In particular, if a motorist veers off a road, they may collide with a roadside pole. Depending on the speed of the motorist's vehicle and the type of roadside pole, the motorist may be seriously injured when colliding with the roadside pole.

By way of example, if the roadside pole remains steadfast and suddenly stops a motorist travelling at a relatively high speed, the motorist will experience a relatively high peak g-force. This high peak g-force may contribute to, amongst other things, serious injury for the motorist. This injury is known as a deceleration injury.

Furthermore, in the event that a motorist shears the roadside pole from a ground footing, the momentum of the motorist's vehicle may carry them into other objects causing more damage. Another source of a danger when colliding with a roadside pole is the pole collapsing onto the motorist's vehicle. The weight of the pole falling on the motorist's vehicle may, for instance, crush the motorist inside their vehicle.

OBJECT OF THE INVENTION

It is an aim of this invention to provide a support which overcomes or ameliorates one or more of the disadvantages or problems described above, or which at least provides a useful alternative.

Other preferred objects of the present invention will become apparent from the following description.

SUMMARY OF INVENTION

In one form, although not necessarily the only or broadest form, the invention resides in a support for a roadside object, the support including:

a hollow elongate body comprising:

a first section having a plurality of first apertures separated by a first distance; and a second section having a plurality of second apertures separated by a second distance, wherein the first distance is different to the second distance.

Preferably, the support includes a base portion.

Preferably, the base portion is in the form of a base plate.

Typically, the base portion is connected along a bottom portion of the hollow elongate body.

Normally, the base portion extends outboard of the hollow elongate body.

Preferably, the base portion includes a recess portion. Preferably, the hollow elongate body is received into the recess portion.

Normally, the support includes one or more reinforcement members.

Preferably, the one or more reinforcement members are connected between the hollow elongate body and the base portion.

Typically, the one or more reinforcement members extends along an inner wall of the hollow elongate body and are connected to the base portion.

Normally, the first section is located below the second section.

Typically, the first section substantially abuts the second section.

Preferably, the plurality of first apertures are substantially aligned with the plurality of second apertures thereabove.

Typically, the hollow elongate body includes a plurality of corner portions.

Normally, the plurality of first apertures and/or the plurality of second apertures are substantially located along one or more of the plurality of corner portions.

Preferably, along two adjacent corner portions, the plurality of first apertures extend therealong.

Typically, along two adjacent corner portions, the plurality of second apertures extend along one of the corner portions.

Normally, the plurality of first apertures extending along the two adjacent corner portions are staggered relative to one another.

Preferably, the plurality of first apertures and/or the plurality of second apertures are in the form of slots.

Preferably, the plurality of first apertures and/or the plurality of second apertures are greater than approximately 10 mm long.

Typically, the plurality of first apertures and/or the plurality of second apertures are approximately between 50 mm to 150 mm long.

Normally, the plurality of first apertures and/or the plurality of second apertures are approximately 100 mm long.

Preferably, the first distance is smaller than the second distance.

Preferably, the first distance is from approximately 1 mm to below approximately below 10 mm.

Typically, the second distance is from approximately 10 mm to approximately 20 mm.

Preferably, the plurality of first apertures are located within up to approximately 3000 mm above the bottom of the hollow elongate body.

Normally, the plurality of first apertures are located within up to approximately 2500 mm above the bottom of the hollow elongate body.

Preferably, the plurality of second apertures are located from approximately 2000 mm above the bottom of the hollow elongate body to within approximately 6000 mm above the bottom of the hollow elongate body.

Typically, the plurality of second apertures are located from approximately 2500 mm above the bottom of the hollow elongate body to within approximately 5000 mm above the bottom of the hollow elongate body.

Normally, the plurality of first apertures and/or the plurality of second apertures extend through the hollow elongate body.

In a further form, the plurality of first apertures and/or the plurality of second apertures extend part way into the hollow elongate body.

Preferably, the hollow elongate body includes at least three sides.

Preferably, the hollow elongate body is in the form of a pole.

Normally, the hollow elongate body is octagonal in shape.

Preferably, the hollow elongate body includes a weld seam along one of the corner portions.

Preferably, the hollow elongate body includes an access aperture. Preferably, the access aperture includes a cover thereover.

Typically, the support includes an extension member.

Preferably, the extension member is connected at a top portion of the hollow elongate body.

Normally, the extension member is telescopically connected to the hollow elongate body.

Preferably, the roadside object is supported at or near a top portion of the hollow elongate body and/or at or near a top portion of the extension member.

Preferably, the roadside object includes a sign and/or a light.

In another form the invention resides in a support for a roadside object, the support including:

a hollow elongate body comprising:

a first section having a plurality of first apertures separated by a first distance; and a second section having a plurality of second apertures separated by a second distance that is different to the first distance, wherein in response to a vehicle colliding with the first section, the first section is configured to deform in a direction that is substantially parallel with a direction of travel of the vehicle whilst keeping the upper part of the hollow elongate body in somewhat of an upward direction.

Preferably, the hollow elongate body is as described herein.

Normally, the support includes a base portion as described herein.

Preferably, the support includes one or more reinforcement members as described herein.

In another form the invention resides in a support for a roadside object, the support including:

a hollow elongate body comprising:

a first section;

a second section above the first section; and an upper section above the second section, wherein in response to a vehicle weighing between approximately 1000 kg to 1600 kg colliding with the first section at approximately 45 km/hr to 75 km/hr, the first section is configured to deform in a manner such that the upper section remains somewhat in an upward direction.

Preferably, the hollow elongate body is as described herein.

Preferably, the first section is configured to deform through the use of a plurality of first apertures.

Preferably, the upper section is in the form of the extension member as described herein.

Preferably, the vehicle weighs between 1100 kg and 1500 kg.

Preferably, the speed of the vehicle is approximately between 50 km/hr to 70 km/hr.

In another form the invention resides in a method for making a support for a roadside object, the method including the steps of:

forming a plurality of first apertures in a hollow elongate body, the plurality of first apertures separated by a first distance;

forming a plurality of second apertures in the hollow elongate body, the plurality of second apertures separated by a second distance, wherein the first distance is different to the second distance.

Preferably, the method further includes the step of forming the hollow elongate body.

Preferably, the step of forming the hollow elongate body includes folding a metal sheet to form the hollow elongate body.

Preferably, the method further includes welding two portions of the folded metal sheet together.

Preferably, the step of forming the plurality of first apertures and/or the step of forming the plurality of second apertures includes cutting the apertures along one or more corner portions of the hollow elongate body.

Preferably, the method further includes connecting a base portion to the hollow elongate body.

Preferably, the method further includes connecting one or more reinforcement members between the hollow elongate body and the base portion.

Preferably, the hollow elongate body, plurality of first apertures, plurality of second apertures, base portion and/or one or more reinforcement members is as described herein.

In another form the invention resides in a method for making a support for a roadside object, the method including the steps of:

forming a plurality of first apertures in a metal sheet, the plurality of first apertures separated by a first distance;

forming a plurality of second apertures in the metal sheet, the plurality of second apertures separated by a second distance; and folding the metal sheet to form a hollow elongate body, wherein the first distance is different to the second distance.

Preferably, the method further includes welding two portions of the folded metal sheet together.

Preferably, the hollow elongate body, plurality of first apertures, plurality of second apertures, base portion and/or one or more reinforcement members is as described herein.

Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures, wherein.

DETAILED DESCRIPTION OF THE DRAWINGS

Figure 1:
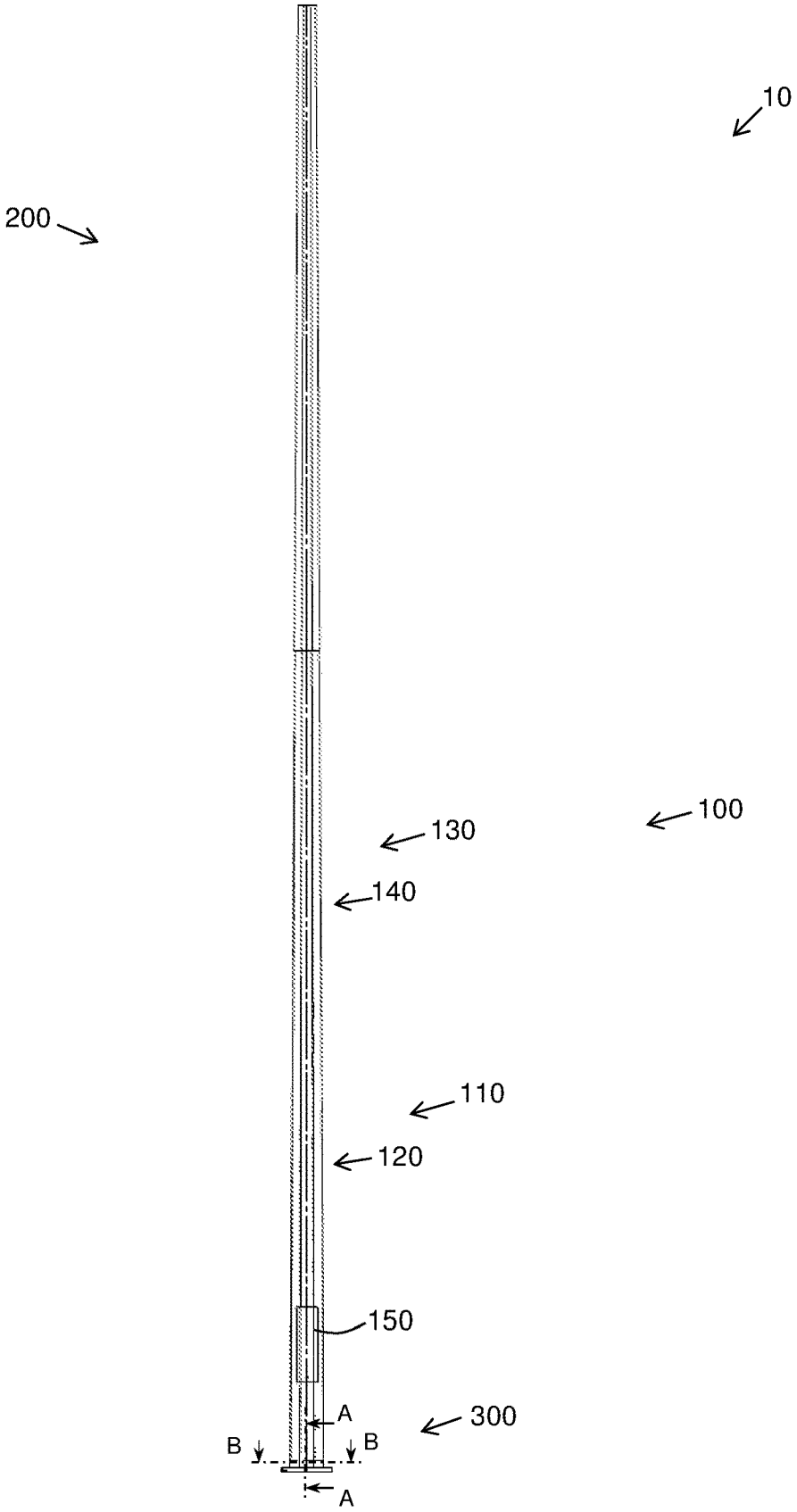
FIG. 1 illustrates a front view of a support for a roadside object, according to an embodiment of the invention.

FIG. 1 illustrates a front view of a support 10 for a roadside object, according to an embodiment of the invention. The support includes a hollow elongate body 100, an extension member 200, a base portion in the form of a base plate 300 and reinforcement members 400.

As indicated further in FIGS. 2 to 7, the hollow elongate body 100 has eight sides between an upper and lower end. The hollow elongate body 100 is therefore substantially octagonal in shape in this embodiment, but it would be appreciated that in further embodiments this shape may change. The hollow elongate body 100 is formed from a sheet of metal that has been folded into shape. A weld seam 102 connects two longitudinal edges of the sheet metal together in order to tie the hollow elongate body 100 together.

Figures 2, 3, 4, 5:
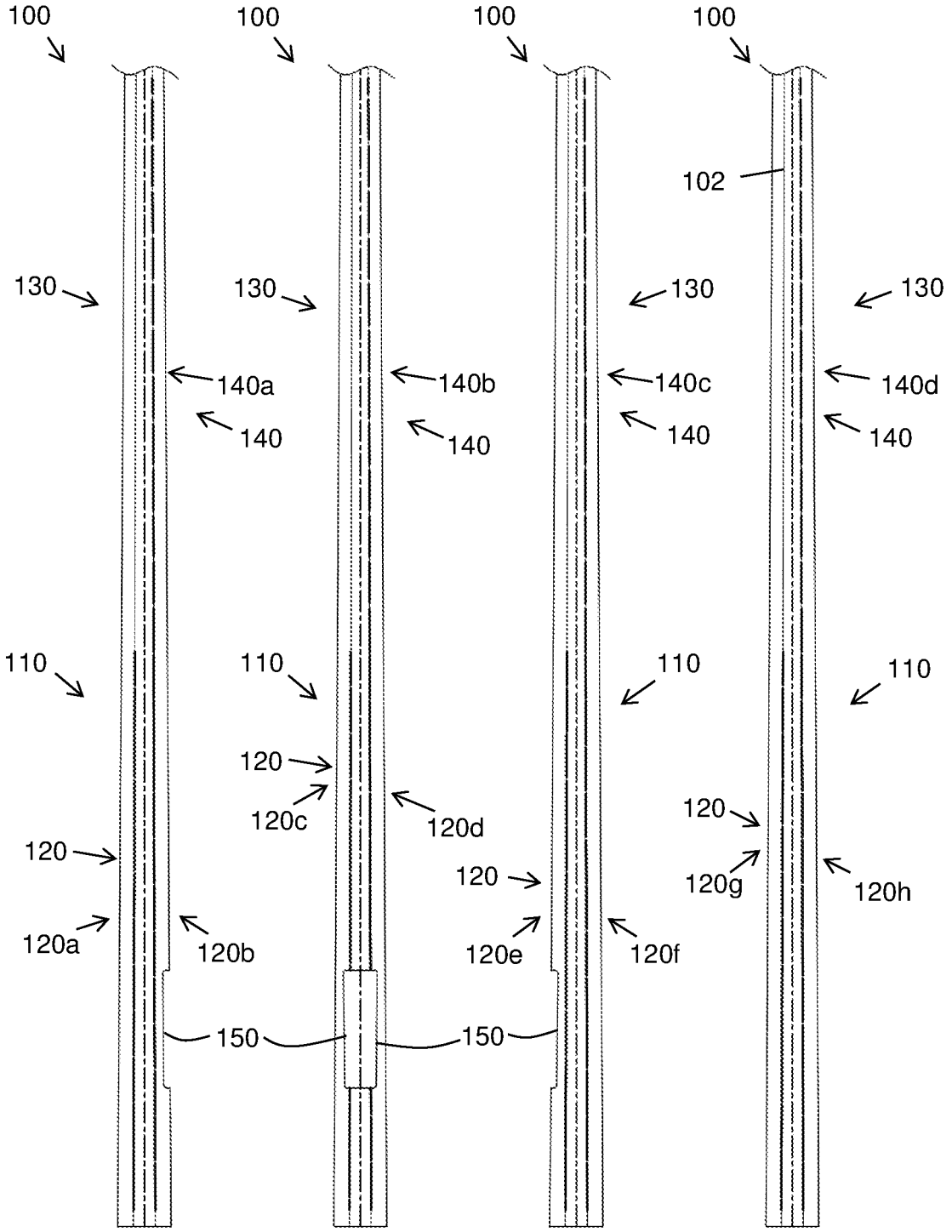
FIG. 2 illustrates a left side view of a hollow elongate body, shown in FIG. 1, according to an embodiment of the invention.
FIG. 3 illustrates a front view of the hollow elongate body, shown in FIGS. 1 to 2, according to an embodiment of the invention.
FIG. 4 illustrates a right side view of the hollow elongate body, shown in FIGS. 1 to 3, according to an embodiment of the invention.
FIG. 5 illustrates a rear view of the hollow elongate body, shown in FIGS. 1 to 4, according to an embodiment of the invention.

The hollow elongate body 100 includes a first section 110 having a plurality of first apertures 120 extending therethrough. The first section 110 extends approximately 2500 mm above the bottom of the hollow elongate body 100 with the plurality of first apertures 120 therein. As shown in FIG. 2, the plurality of first apertures 120 include a first set of apertures 120*a* and a second set of aperture 120*b*. The first set of apertures 120*a* are located along a first corner portion of the hollow elongate body 100. The second set of apertures 120*b* are located along a second corner portion of the hollow elongate body 100.

The first and second set of apertures 120*a*, 120*b* are substantially the same in shape. That is, the first and second set of apertures 120*a*, 120*b* are slots that are approximately 100 mm in length. The first and second set of apertures 120*a*, 120*b* are separated by a first distance of approximately 6 mm. The first set of apertures 120*a* are staggered with respect to the second set of apertures 120*b*. This staggered pattern is similar to the pattern found in brickwork. More specifically, if a projection of one aperture from the first set of apertures 120*a* is taken across the hollow elongate body 100, it will partly overlap two apertures of the second set of apertures 120*b*. This general overlap feature is repeated across the sets of apertures 120*a*, 120*b*.

The hollow elongate body 100 also includes a second section 130 having a plurality of second apertures 140 extending therethrough. The second section 130 extends from approximately 2500 mm above the bottom of the hollow elongate body 100 to approximately 5000 mm above the bottom of the hollow elongate body. The plurality of second apertures 140 are located above the plurality of first apertures 120. As shown in FIG. 2, the plurality of second apertures 140 includes a first set of apertures 140*a*. The apertures 140*a* are substantially aligned with the apertures 120*b* therebelow. In this regard, the apertures 140*a* extend along the second corner portion.

The apertures 140*a* are slots that are approximately 100 mm in length. The apertures 140*a* are separated by a second distance of approximately 15 mm. On this basis, the distance between the apertures 120*a*, 120*b* is less than the distance between the apertures 140*a*. This assists with deforming the hollow elongate body 100 in a particular manner, as further outlined below.

As shown in FIGS. 3 to 5, the plurality of first apertures 120 includes a number of other sets of apertures 120*c*, 120*d*, 120*e*, 120*f*, 120*g*, 120*h* that are substantially similar to the apertures 120*a*, 120*b*, respectively. That is, the sets of apertures 120*c*-120*h* are slots that are approximately 100 mm in length and are separated by the first distance above (i.e. approximately 6 mm). The apertures 120*c*, 120*e*, 120*g* are staggered with respect to the apertures 120*d*, 120*f*, 120*h*, respectively. The apertures 120*c*-120*h* are located along respective corner portions of the hollow elongate body 100.

The plurality of second apertures 140 also includes a number of other sets of apertures 140*b*, 140*c*, 140*d* that are substantially similar to the apertures 140*a*. That is, the set of apertures 140*b*-140*d* are slots that are approximately 100 mm in length and are separated by the second distance above (i.e. approximately 15 mm). The sets of apertures 140*b*-140*d* are respectively aligned with the apertures 120*d*, 120*f*, 120*h* therebelow. In this regard, the apertures 140*b*-140*d* are located along respective corner portions of the hollow elongate body 100.

The hollow elongate body 100 also includes an access aperture 150. The access aperture 150 is located in the first section 110. The access aperture 150 is typically covered with a cover (not shown). The set of apertures 120*c*, 120*d* are located either side of the access aperture 150. On this basis, the set of apertures 120*c*, 120*d* include less apertures compare to the sets of apertures 120*a*-120*b* and 120*e*-120*h*.

As shown in FIG. 1, the extension member 200 is located above the hollow elongate body 100. The extension member 200 is substantially hexagonal in shape and is configured to be slipped over the hollow elongate body 100 to a predetermined point. The extension member 200 is configured to hold a roadside object thereabove. The roadside object may include a sign, light, camera and/or further extension member.

Figure 6:
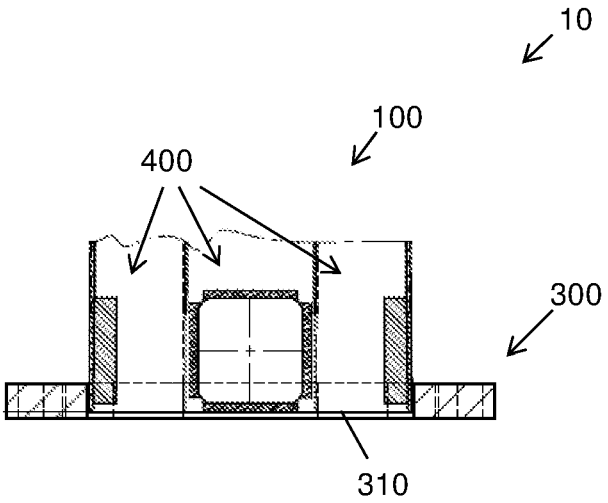
FIG. 6 illustrates a first cross section view of the support, shown in FIG. 1, according to an embodiment of the invention.
Figure 7:
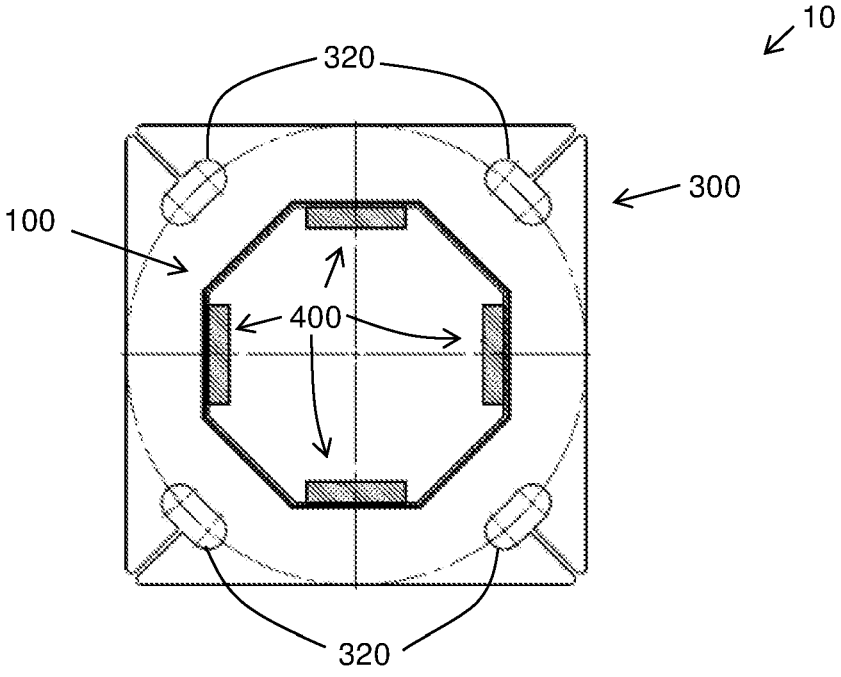
FIG. 7 illustrates a second cross section view of the support, shown in FIG. 1, according to an embodiment of the invention.

As further indicated in FIGS. 6 and 7, which respectively show cross sectional views across lines A-A and B-B in FIG. 1, the base plate 300 in this embodiment is substantially square. The base plate 300 is connected to the hollow elongate body 100. The base plate 300 includes a recess portion 310. The recess portion 310 is configured to receive the hollow elongate body 100 therein. The base plate 300 also includes a plurality of apertures therethough in the form of slots 320.

The reinforcement members 400 are connected between the hollow elongate body 100 and the base plate 300. The reinforcement members 400 are located along four inner surfaces of the hollow elongate body 100. The reinforcement members 400 are substantially square and approximately 16 mm thick, but it would be appreciated in further embodiments that this shape may change.

In response to a vehicle colliding with the support 10, the first section 110 of the hollow elongate body 100 is configured to act like a net in reducing the vehicle's momentum. By way of example, the first section 110, through the use of the apertures 120 from at least the point of impact of the vehicle and part thereabove, is configured to deform in a direction that is substantially parallel with a direction of travel of the vehicle. This results in at least part of the first section 110 transitioning in a direction parallel with the direction of travel of the vehicle. It would be appreciated that the second section 130 may also form part of this transition, through the use of the apertures 140, depending on the momentum of the vehicle.

As part of the first section 110 transitions in a direction parallel with the direction of travel of the vehicle, part of the hollow elongate body 100 thereabove stays somewhat in an upward direction. In this regard, it would be appreciated that the hollow elongate body 100 curves around the vehicle, after an impact, in order to keep the upper part of the support 10 in somewhat of an upward direction. In particular, in response to a vehicle weighing approximately 1000 kg to 1600 kg colliding with the support 10, at an approximate speed between 45 km/hr to 75 km/hr, the upper part of the support 10 remains in an upward direction and does not fall onto, for example, the vehicle.

The support 10 provides a means for reducing the peak g-force experienced during a vehicle accident. In particular, the first section 110, and the second section 130 if required, is configured to deform in a direction substantially parallel with the momentum of the vehicle in order to reduce said momentum in a relatively less abrupt manner. This means for reducing the peak g-force, experienced during a vehicle accident, is due to at least the plurality of first apertures 120 and the plurality of second apertures 140.

Furthermore, the reinforcement members 400 provide further strength for the connection between the hollow elongate body 100 and the base plate 300. Accordingly, the reinforcement members 400 further assist in preventing the hollow elongate member 100 shearing away from the base plate 300 during a vehicle accident.

In addition, as the upper part of the support 10 is kept in an upward direction during an accident, this substantially avoids having part of the support 10 fall onto the vehicle. This reduces the risk to a driver and alike during an accident.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In this specification, the terms 'comprises', 'comprising', 'includes', 'including', or similar terms are intended to mean a non-exclusive inclusion, such that a method, system or apparatus that comprises a list of elements does not include those elements solely, but may well include other elements not listed.

The claims defining the invention are as follows:

1. A support for a roadside object, the support including:

a hollow elongate body comprising:

a hollow first section having a plurality of first apertures separated by a first distance;

a hollow second section having a plurality of second apertures separated by a second distance, a bottom portion of the second section being connected to a top portion of the first section; and a base portion connected along a bottom portion of the hollow elongate body, the first section being located between the base portion and the second section, and the bottom portion of the second section being located at a distance from the base portion, wherein the plurality of first apertures and the plurality of second apertures are in the form of slots and extend along a longitudinal edge of the hollow elongate body, wherein the second distance is greater than the first distance, wherein the plurality of first apertures and the plurality of second apertures do not have fasteners located therethrough and are configured to remain unobstructed in use, and wherein the base portion comprises:

a base plate including a plurality of slots therethrough and an octagonally shaped recess portion, the recess portion receiving the first section of the hollow elongate body therein; and a plurality of reinforcement members, the plurality of reinforcement members being connected between the first section and the base plate, the plurality of reinforcement members being located along inner surfaces of the first section.

2. The support of claim 1, wherein the base portion extends outboard of the hollow elongate body.

3. The support of claim 1, wherein one or more reinforcement members are connected between the hollow elongate body and the base portion.

4. The support of claim 1, wherein the plurality of first apertures are substantially aligned with the plurality of second apertures thereabove.

5. The support of claim 1, wherein along two adjacent longitudinal edges, the plurality of first apertures extend therealong.

6. The support of claim 1, wherein along two adjacent longitudinal edges, the plurality of second apertures extend along one of the longitudinal edges.

7. The support of claim 1, wherein the plurality of first apertures and/or the plurality of second apertures are approximately 100 mm long.

8. The support of claim 1, wherein the first distance is approximately from 1 mm to approximately below 10 mm.

9. The support of claim 1, wherein the second distance is approximately from 10 mm to approximately below 20 mm.

10. The support of claim 1, wherein the plurality of first apertures are located up to within approximately 2500 mm above a bottom of the hollow elongate body.

11. The support of claim 1, wherein the hollow elongate body is octagonal in shape.

12. The support of claim 1, wherein the hollow elongate body includes a weld seam along one corner portion.

13. The support of claim 1, wherein an extension member is connected to the hollow elongate body.

14. The support of claim 13, wherein the extension member is telescopically connected to the hollow elongate body.

15. The support of claim 1, wherein the first section and the second section are octagonally shaped, the first section being positioned substantially above the base portion and substantially below the second section.

16. The support of claim 1, wherein the first section further includes an access aperture.

* * * * *